US012442170B2

(12) United States Patent
Shalom et al.

(10) Patent No.: US 12,442,170 B2
(45) Date of Patent: Oct. 14, 2025

(54) SEMI-CLOSED COMPARTMENT GAS MANAGEMENT SYSTEM AND METHOD

(71) Applicant: LOOCID AIR LTD., Herzliya-Pituach (IL)

(72) Inventors: Moshe Shalom, Herzliya-Pituach (IL); Doron Shalom, Tel-Aviv (IL)

(73) Assignee: LOOCID AIR LTD., Herzliya-Pituach (IL)

( * ) Notice: Subject to any disclaimer, the term of this patent is extended or adjusted under 35 U.S.C. 154(b) by 136 days.

(21) Appl. No.: 18/567,503

(22) PCT Filed: May 24, 2022

(86) PCT No.: PCT/IL2022/050546

§ 371 (c)(1),
(2) Date: Dec. 6, 2023

(87) PCT Pub. No.: WO2022/259236

PCT Pub. Date: Dec. 15, 2022

(65) Prior Publication Data

US 2024/0271404 A1 Aug. 15, 2024

(30) Foreign Application Priority Data

Jun. 8, 2021 (IL) ..... 283825

(51) Int. Cl.
*E03D 9/05* (2006.01)

(52) U.S. Cl.
CPC ..... *E03D 9/05* (2013.01)

(58) Field of Classification Search
CPC ..... E03D 9/05; E03D 9/052
USPC ..... 4/216
See application file for complete search history.

(56) References Cited

U.S. PATENT DOCUMENTS

| | | | | |
|---|---|---|---|---|
| 2,297,935 | A * | 10/1942 | Baither | E03D 9/052 4/213 |
| 3,579,650 | A * | 5/1971 | Sloan | E03D 9/04 4/215 |
| 3,681,790 | A * | 8/1972 | Dooley | E03D 9/052 4/216 |
| 4,800,596 | A * | 1/1989 | Menge | E03D 9/052 4/351 |
| 5,361,422 | A * | 11/1994 | Vincent | E03D 9/05 4/216 |
| 6,173,453 | B1 * | 1/2001 | Shahar | E03D 9/05 4/216 |
| 7,380,292 | B1 | 6/2008 | Harris | |
| 2013/0086736 | A1 | 4/2013 | Larouche | |

(Continued)

FOREIGN PATENT DOCUMENTS

| | | | |
|---|---|---|---|
| DE | 3534494 | A1 | 4/1987 |
| EP | 0219622 | A2 | 4/1987 |
| GB | 2305944 | A | 4/1997 |

(Continued)

*Primary Examiner* — Huyen D Le
(74) *Attorney, Agent, or Firm* — FisherBroyles, LLP; Roger L. Browdy

(57) ABSTRACT

A gas management system and method for safe removal of undesirous gas through readily available discharge means comprising a reliable and autonomous block prevention means configured to mitigate the tendency of conduit systems to gradually/abruptly develop blockages from various reasons.

20 Claims, 12 Drawing Sheets

(56) References Cited

U.S. PATENT DOCUMENTS

2017/0204595 A1 7/2017 Hall et al.

FOREIGN PATENT DOCUMENTS

| | | | |
|---|---|---|---|
| GB | 2334042 | A | 8/1999 |
| KR | 100752932 | B1 | 8/2007 |
| WO | 1997035075 | A1 | 9/1997 |
| WO | 2014136120 | A1 | 9/2014 |

* cited by examiner

SEMI-CLOSED COMPARTMENT GAS MANAGEMENT SYSTEM AND METHOD

FIELD OF THE INVENTION

The present invention generally relates to gas management systems and methods directed at removing undesirous gasses from semi-closed spaces, and more particularly, to semi-closed compartment gas management systems and methods configured to dispose of undesirous gases into discharge means.

BACKGROUND OF THE INVENTION

Gas management systems and methods are directed at removing undesirous gasses from semi-closed spaces such as toilets, kitchens, eating halls (e.g., restaurants), laboratories and other private and publicly used spaces. Such removal of gas may be desirous so as to remove bad/unpleasant/hazardous gasses/odors that may accumulate in semi-closed spaces and pose a disturbance to a user's comfort, health, safety, etc.

Some prior art publications have addressed this need disclosing various approaches. For example:

- Patent publication U.S. Pat. No. 7,380,292B discloses a toilet modular system comprising an automatic toilet ventilator which vacuums objectionable odor from a toilet bowl and exhausts it to the sewer discharge pipeline and further comprising a gas backflow prevention mechanism that uses a "ball trap" construction.
- Patent publication GB2305944A discloses a water tank spilling tube structure with a gas exhaustion function comprising a sucking pump, wherein the sucking pump is controlled by the throttle which is switched on/off by a floating ball.
- Patent application WO9735075A1 discloses an odor removing system for a toilet consisting a blower having its inlet connected to a toilet bowl and an outlet connected to a discharge sewer pipeline, wherein the blower is driven by a rotary water motor which is actuated by water entering the initially empty toilet tank.
- Patent application WO2014136120A1 discloses an odor removing system for a toilet configured to remove bad odors and diverting them to the sewage pipeline, wherein an external siphon/water lock line, located outside the toilet tank is further configured to restrict the return flow of diverted gas from the sewer pipeline.
- Patent publication U.S. Pat. No. 5,361,422A discloses a toilet ventilating system for use with a toilet bowl incorporating a sewer line connection and including an upstanding vent conduit leading from a bowl rim outlet to an elevated cross over in the water storage tank and then dropping downwardly to form an exhaust conduit connected with the sewer pipeline and further comprising a fluid barrier trap valve having a tight seal float component.

Current gas management systems and methods usually remove gas to other closed spaces or to the open-air, causing discomfort or even hazard to other persons in the vicinity of the semi-closed space.

Currently available gas management systems and methods to be installed in currently available hosting systems, such as toilet cisterns, kitchens, laboratory fume removers, etc., require pre-design and inclusion that, in turn, require substantial and sometimes expensive retrofitting or reconfiguration which affects the operation and efficiency of the hosting systems. Such available systems do not address the issues of maintainability with which hard or sediment heavy water conduction systems are faced with (such as a result of limescale).

Furthermore, currently available gas management systems and methods focus on removal of gas regardless of its actual nature and without its analysis.

Thus, there is a need in the art to provide a smart gas management system and method for safe removal of undesirous gas through readily available discharge means, wherein said system is installable at reasonable cost without affecting operation or efficiency of hosting system.

There is a further need to provide gas management system and method comprising autonomous block prevention means configured to mitigate the tendency of conduit systems to gradually/abruptly develop blockages for various reasons.

SUMMARY OF THE INVENTION

The present invention discloses a cost effective efficient and smart gas management system and method for safe removal of undesirous gas through readily available discharge means.

The present invention further discloses a gas management system and method comprising a reliable and autonomous block prevention means configured to mitigate the tendency of conduit systems to gradually/abruptly develop blockages from various reasons.

The following embodiments and aspects thereof are described and illustrated in conjunction with systems, devices and methods which are meant to be exemplary and illustrative and not limiting in scope. In various embodiments, one or more of the above-described problems have been reduced or eliminated, while other embodiments are directed to other advantages or improvements.

According to one aspect, there is provided a semi-closed compartment gas management system comprising a power source, an impeller configured to be driven by the power source and create a gas flow, a conduit having a gas inlet in communication with a semi-closed compartment and an outlet in contact with a discharge means, a fluid barrier receptacle comprising a fluid inlet aperture and configured to be connected to the conduit between its gas inlet and outlet, wherein the gas flow created by the impeller is designated to flow from the semi-closed compartment and through the conduit and wherein the fluid barrier receptacle is configured to block gas originating in the discharge means from spreading to the semi-closed compartment while the impeller is not operating and wherein the fluid inlet aperture further comprises autonomous block prevention means.

According to some embodiments, the gas flow created by the impeller is induced by drawing air through a conduit inlet being in communication with a toilet bowl, the fluid barrier receptacle is configured to be located within a toilet tank and comprising an inlet aperture configured to enable flow of water from the water tank into the fluid barrier receptacle, the fluid barrier receptacle further comprising a float component configured to be vertically adjustable in accordance with the water level within the toilet tank, wherein the float component is configured to operate as an autonomous block prevention means by comprising a protrusion having a clearance gap fit with the fluid inlet aperture, wherein the gas drawn by the impeller is configured to be discharged into a sewer pipeline as a discharge means, wherein the fluid barrier receptable is configured to block odors originated in the sewer pipeline from spreading to the toilet bowl, and wherein said protrusion is configured to alternately fit (i.e. alternate between positions such as in/out or partially in/out) with the inlet aperture in accordance with the water level in the toilet tank.

According to some embodiments, the protrusion is a rod having ridges and grooves.

According to some embodiments, the conduit is configured to connect to an over-flow pipe forming a part of a toilet bowl flushing device.

According to some embodiments, the impeller is configured to be acoustically isolated.

According to some embodiments, the semi-closed compartment gas management system is configured by modular commercially available components.

According to some embodiments, the semi-closed compartment gas management system is configured to be compactly fitted and installed within commercially available toilet bowl flushing systems.

According to some embodiments, the fluid barrier receptacle is configured to be filled with fluid entering through the inlet aperture.

According to some embodiments, the fluid barrier receptacle is configured to be filled with fluid sourced from a pre-contained reservoir entering through the inlet aperture.

According to some embodiments, the float component is configured as a fluid reservoir of toilet tank water contained in said float component prior or during flushing and designated to enter the float component through the inlet aperture upon termination of gas removal action.

According to some embodiments, the semi-closed compartment gas management system further comprising means for sampling the drawn gas in the conduit and at least one sensor, wherein the sample is designated to be exposed to the sensor.

According to some embodiments, the at least one sensor is configured to collect data regarding the sampled drawn gas.

According to some embodiments, the semi-closed compartment gas management system further comprising a controller configured to diagnose collected data by analyzing the at least one sensor output data.

According to some embodiments, the semi-closed compartment gas management system is configured to transmit the gathered data to a designated device or data center for further analysis or display.

According to some embodiments, transmittal of the gathered data is conducted on an immediate real-time basis.

According to some embodiments, the semi-closed compartment is a fume hood and wherein the system is configured to draw air from inner cavity of the exhaust hood and dispose it into a discharge pipe.

According to some embodiments, the alternating operation of the block prevention means is configured to prevent or remove scale deposits from the inlet aperture.

According to some embodiments, the power source is a rechargeable power reservoir that may be configured to be charged by a water flow created when a toilet tank is filled and/or be charged wirelessly.

According to some embodiments, the fluid barrier receptable is configured to be filled with 20-250 mm of water and/or configured to be in a U-shaped conduit and/or has a compact siphon configuration.

According to some embodiments, the inlet aperture is configured to allow entrance of fluid filling the water barrier receptable and wherein upon operation the impeller is configured to draw water in the water barrier receptacle and dispose of it into the sewer pipeline.

According to some embodiments, the semi-closed compartment gas management system is operatable by a remote control.

According to some embodiments, the semi-closed compartment gas management system is operatable by a wireless control means (such as cellular, Bluetooth or Wi-Fi application).

According to a second aspect, there is provided a method for using a semi-closed compartment gas management system comprising the steps of: applying an impeller to create a gas flow through a conduit having a gas inlet in communication with a semi-closed compartment and an outlet in contact with a discharge means, wherein said flow also passes through a fluid barrier receptacle comprising a fluid inlet aperture and configured to be connected to the conduit between its gas inlet and outlet, utilizing said gas flowing from the semi-closed compartment through the conduit and the fluid barrier receptacle in order to discharge gas from the semi-closed compartment, and utilizing the fluid barrier receptacle to block gas originating in the discharge means from spreading to the semi-closed compartment when the impeller is not operating.

According to some embodiments, the fluid inlet aperture further comprising a float component vertically adjustable in accordance with the water level within a toilet tank and configured to operate as an autonomous block prevention means by using a protrusion having a clearance gap fit with the fluid inlet aperture.

According to a third aspect, there is provided a semi-closed compartment gas management system, comprising: a power source, an impeller configured to be driven by the power source and create a gas flow, a conduit having a gas inlet in communication with a pipe providing fluid to a semi-closed compartment and an outlet in contact with a discharge means, a fluid barrier receptacle comprising a fluid inlet aperture and configured to be connected to the conduit between its gas inlet and outlet, and a valve device configured to be connected along the conduit comprising at least one gas passageway configured to allow gas to flow from the pipe and into the discharge means and further comprising a float configured to restrict fluid from flowing the same path, wherein the fluid barrier receptacle is configured to block gas originating from the discharge means from spreading to the semi-closed compartment while the impeller is not operating and wherein the float is configured to be dislocated in accordance with the fluid level within the valve device.

According to some embodiments, the float is a ball adapted in its diameter to provide a seal against fluid while floating upon rising water level within the valve device.

According to some embodiments, the semi-closed compartment gas management system further comprising means for sampling the drawn gas and at least one sensor, wherein the sample is designated to be exposed to the sensor.

According to some embodiments, the at least one sensor is configured to collect data regarding the sampled drawn gas.

According to some embodiments, the semi-closed compartment gas management system further comprising a controller configured to diagnose collected data by analyzing the at least one sensor output data.

According to some embodiments, the semi-closed compartment gas management system is configured to transmit the gathered data to a designated device or data center for further analysis or display.

According to some embodiments, the transmittal of the gathered data is conducted on an immediate real-time basis.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention.

In the Figures.

DETAILED DESCRIPTION OF SOME EMBODIMENTS

Figure 1A:
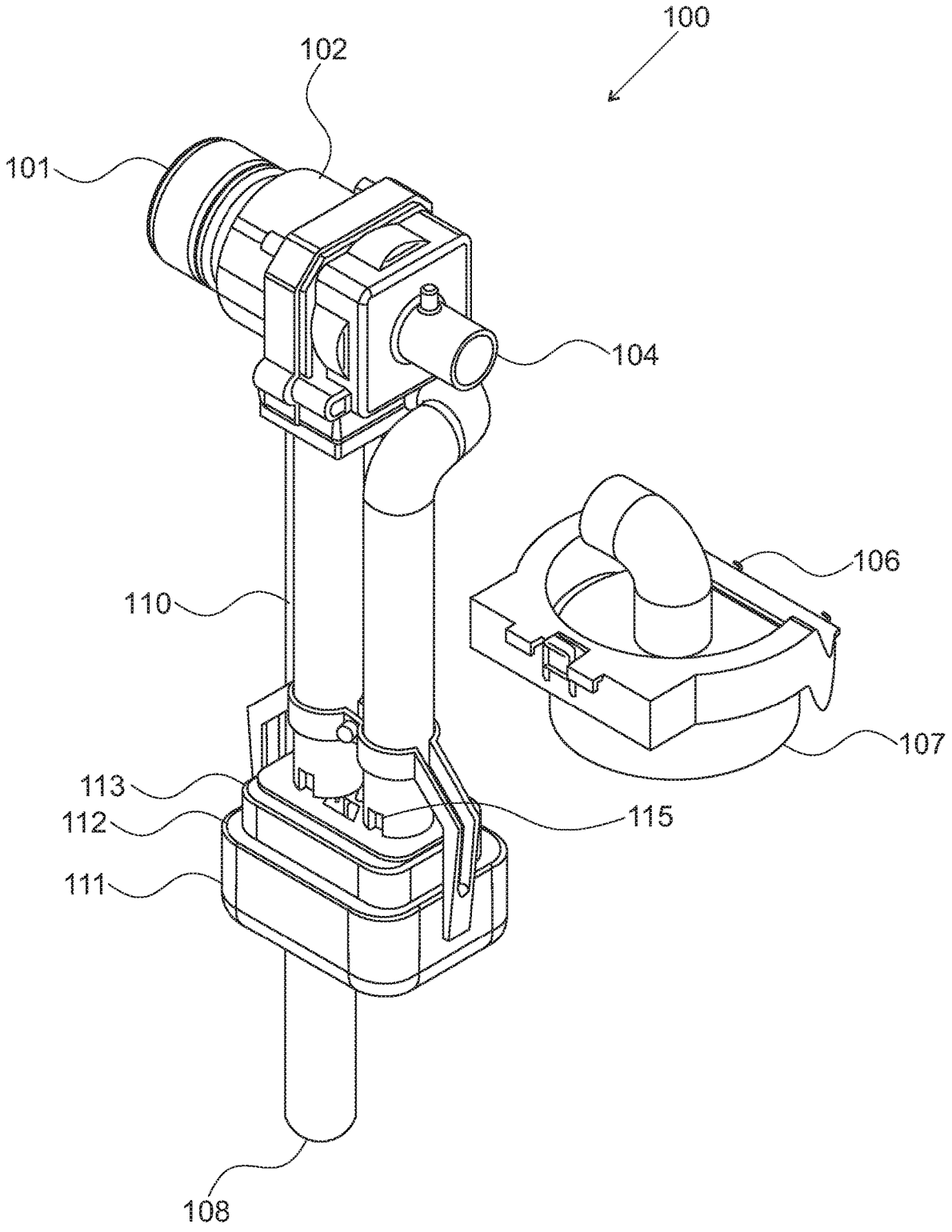
FIGS. 1A-1C constitute schematic perspective views of a semi-closed compartment gas management system components, according to some embodiments of the invention.

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Although embodiments of the invention are not limited in this regard, discussions utilizing terms such as, for example, "controlling" "processing," "computing," "calculating," "determining," "establishing", "analyzing", "checking", "setting", "receiving", or the like, may refer to operation(s) and/or process(es) of a controller, a computer, a computing platform, a computing system, a cloud computing system or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes.

Unless explicitly stated, the method embodiments described herein are not constrained to a particular order or sequence. Additionally, some of the described method embodiments or elements thereof can occur or be performed simultaneously, at the same point in time, or concurrently.

The term "Controller", as used herein, refers to any type of computing platform or component that may be provisioned with a Central Processing Unit (CPU) or microprocessors, and may be provisioned with several input/output (I/O) ports, for example, a general-purpose computer such as a personal computer, laptop, tablet, mobile cellular phone, controller chip, SoC or a cloud computing system.

The current invention discloses a semi-closed compartment gas management system configured to create an airflow and disposed it in order to remove gas from a semi-closed compartment and prevent it from spreading.

According to some embodiments, the semi-closed compartment gas management system is configured to form a part of a toilet sanitary hardware, and be stored within a toilet tank.

According to some embodiments, the semi-closed compartment is configured to form a part of a fume exhaust/hood, wherein the system is configured to draw air from inner cavity of said exhaust/hood and dispose it into a discharge means. According to some embodiments, said fume exhaust/hood may be part of a kitchen, restaurant, laboratory, etc.

According to some embodiments, the gas management system may be configured by modular commercially available components. For example, an impeller configured to create an air stream may be a commercially available blower/fan (for example, a 12V blower), the various conduits forming a part of the gas management system may be available stock parts.

According to some embodiments, utilizing commercially available components to construct the semi-closed compartment gas management system may benefit the system serviceability by enabling the use of widely available spare parts and allowing supply of low-priced components.

According to some embodiments, the impeller may be configured to be acoustically isolated such that the operation of the semi-closed compartment gas management system will not cause any disturbance to the user.

According to some embodiments, the semi-closed compartment gas management system may be configured to compactly be fitted and installed within a commercially available toilet tank, fume exhaust/hood, etc.

According to some embodiments, the semi-closed compartment gas management system may further comprise means for sampling the drawn gas within the conduit and at least one sensor configured to analyze said sample. According to some embodiments, the sensor may be configured to collect data regarding the sampled drawn gas. For example, the semi-closed compartment gas management system installed within a toilet bowl may be configured to analyze the bio-medical condition of a user by sampling gas generated by said user digestion system or diagnose the characteristics of unpleasant gas odors during and after a user uses the toilet bowl. By way of another example, the semi-closed compartment gas management system coupled with a laboratory fume hood may be configured to perform real time analysis of laboratory work products and identify hazardous material situations. According to some embodiments, the semi-closed compartment gas management system may comprise a controller configured to diagnose collected data by analyzing the sensor output data. According to some embodiments, the gathered data may be transmitted to a designated device or data center for further analysis or display. According to some embodiments, said transmittal of the gathered data may be conducted on an immediate real-time basis in order to provide a fast detection system.

According to some embodiments, the semi-closed compartment gas management system is configured to be driven by a power source and create a gas flow. For example, the impeller may be powered by a wall socket electrical connection, by a power reserve such a battery or by a mechanical dynamo creating electricity using the water flow created when a toilet tank is filled. According to some embodiments, the semi-closed compartment gas management system may be configured be driven by a power reserve that can be wirelessly charge, for example, by utilizing inductive charging.

According to some embodiments, the semi-closed compartment gas management system may be operable by a remote control or by any wireless control means such as a cellular RF, Bluetooth or Wi-Fi application, etc.

Figure 1B:
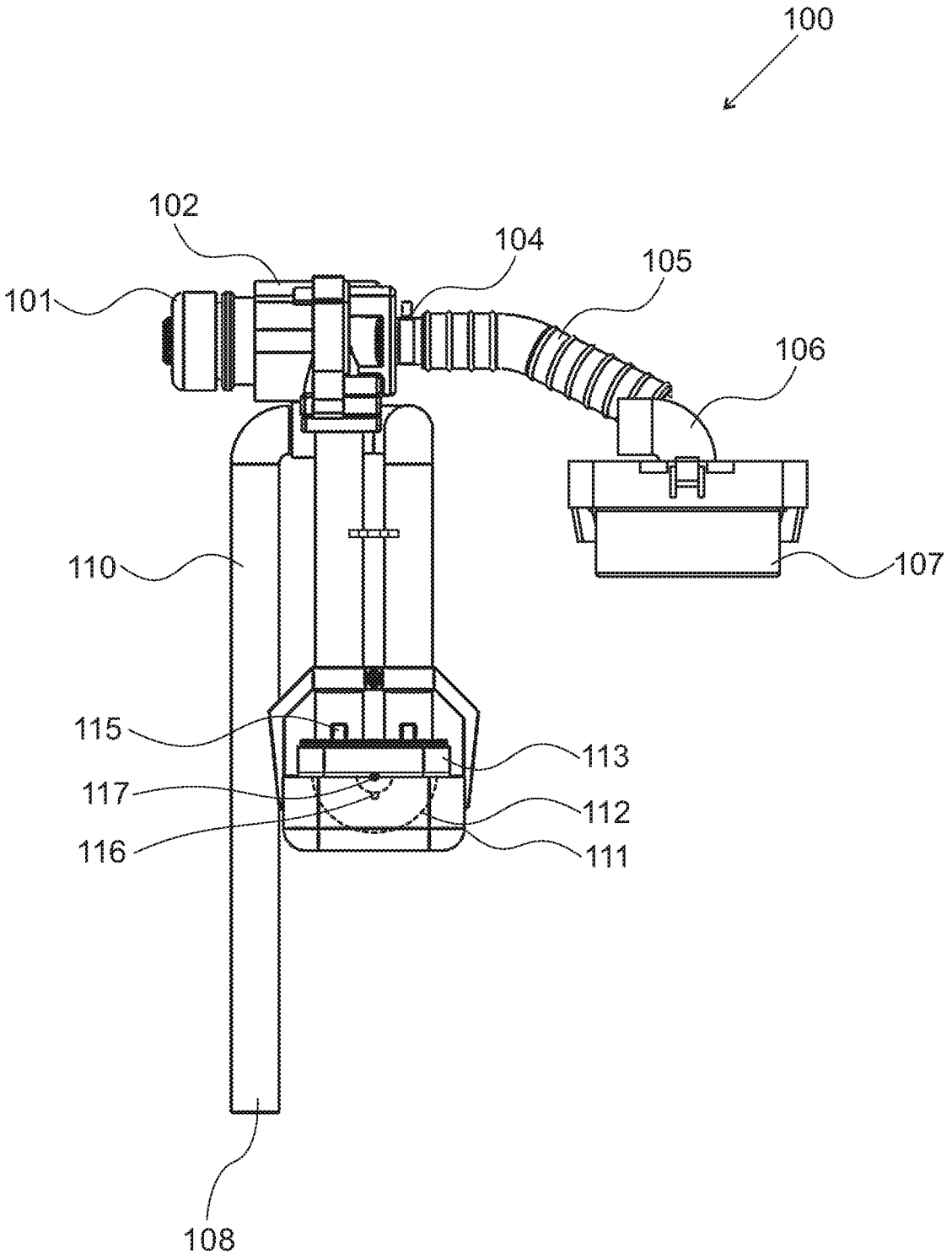
Figure 1C:
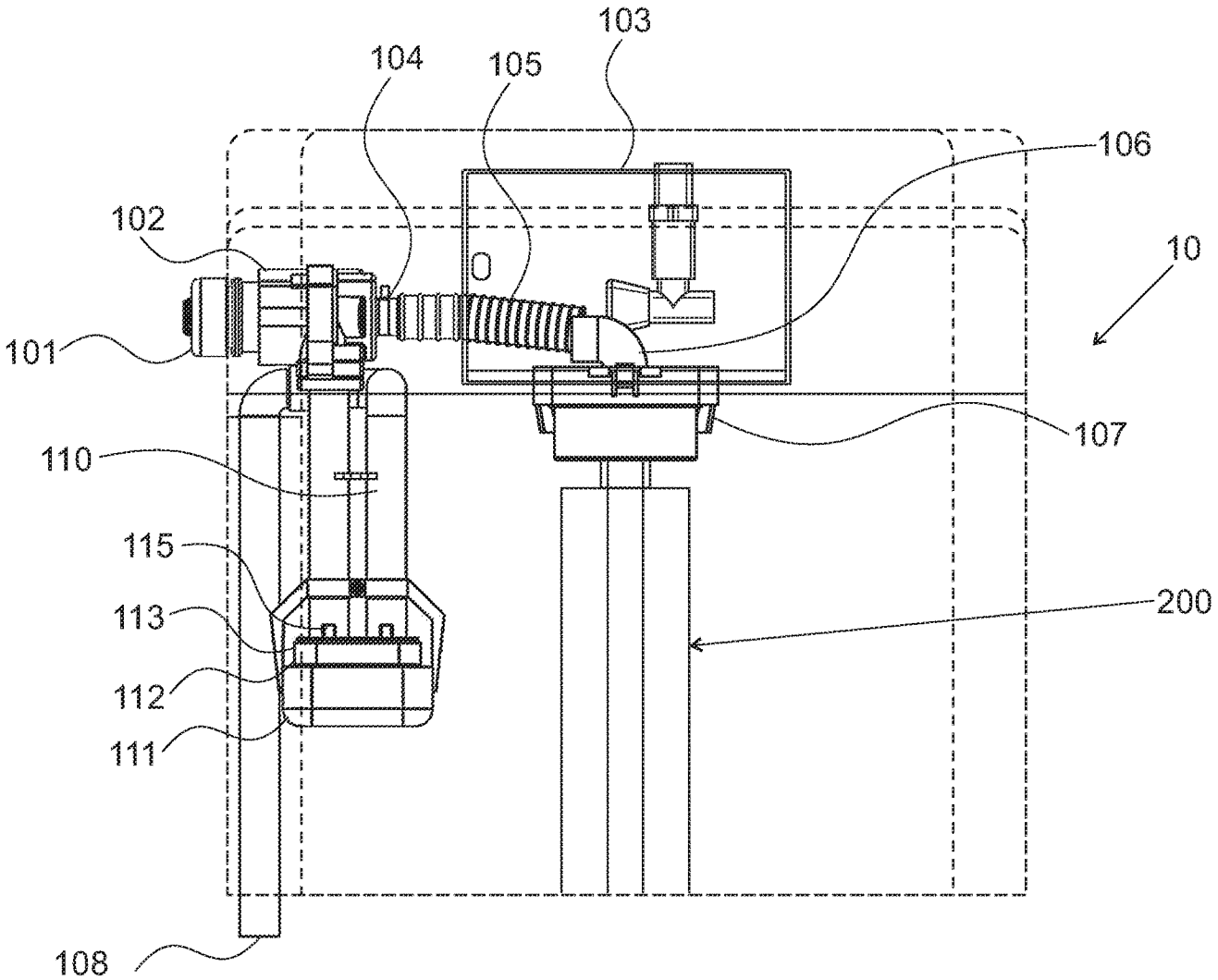

Reference is now made to FIGS. 1A-1C which schematically illustrate a semi-closed compartment gas management system 100. As shown, an impeller 102 is configured to be driven by a power source and create a gas flow. For example, impeller 102 may be a blower configured to create an air stream. According to some embodiments, impeller 102 may be powered by a wall socket electrical connection/by a power reserve such a battery/by a mechanical mechanism converting water stream to electricity/by inductive charging, etc.

According to some embodiments, impeller 102 is configured to create a gas flow passing through conduit inlet 104, along conduit 110 to be discharged through conduit outlet 108 to a discharge means such as a sewer pipeline, wherein conduit inlet 104 may be configured to be in communication with a semi-closed compartment. (not shown). According to some embodiments, a semi-closed compartment may be any receptacle/chamber having an inner volume that is not completely sealed to its outer environment. For example, a semi-closed compartment may be a restroom, a kitchen, a restaurant, a laboratory, an exhaust hood, a toilet bawl, etc.

According to some embodiments, conduit inlet 104 may further be configured to connect to an adaptor 106 having a connector 107 configured to be connected to the semi-closed compartment. According to some embodiments, a resilient tube 105 may be configured to connect inlet 104 with adaptor 106.

According to some embodiments, a fluid barrier receptacle 112 may be configured with a fluid inlet aperture 116 and designated to be installed at any point along conduit 110. According to some embodiments, fluid barrier receptacle 112 may have a siphon configuration, for example, fluid barrier receptacle 112 may be a siphon shaped as an inverted "U" shaped conduit (shown on FIGS. 2A & 2B disclosed hereinafter), configured to be surrounded by a receptacle 111.

According to some embodiments, receptacle 111 may be configured to contain some amount of fluid by preserving a constant amount of water even when the water level within the toilet tanks 10 is low. This configuration provides a barrier against unpleasant odors by allowing fluid to enter the fluid inlet aperture 116 even when the toilet tank 10 is not full or empty.

According to some embodiments, receptacle 111 may be filled with a pre-contained fluid reservoir. This configuration provides a barrier against unpleasant odors by allowing fluid to enter the fluid inlet aperture 116 even when the toilet tank 10 is empty for long period of time, or alternatively, when the semi-closed compartment gas management system 100 is configured to be installed in a hosting system that lacks a water tank.

According to some embodiments, fluid barrier receptacle 112 may further comprise a float section 113 configured to vertically move along conduit 110. According to some embodiments, the float section 113 is restricted to move along a designated path, for example, float section 113 may be restricted to vertically move along tracks 115.

According to some embodiments, the fluid barrier receptacle 112 is configured to block gas originating from the discharge means from spreading to the semi-closed compartment while the impeller 102 is not operating, by providing a receptacle full of fluid, thus preventing gasses from passing and spreading.

According to some embodiments, receptacle 111 which covers fluid barrier receptacle 112 is configured to provide protective shield to fluid barrier receptacle 112 such that various objects present within the toilet tank 10 are unable to penetrate/block the fluid inlet aperture 116. For example, toilet tanks sometimes include a loosen pneumatic cable that plays a part in the flushing mechanism, receptacle 111 which covers fluid barrier receptacle 112 may provide a barrier between said pneumatic cable and the fluid inlet aperture 116 such that the fluid inlet aperture 116 will not be clogged by said pneumatic cable, thus enhancing the system's reliability.

According to some embodiments, fluid barrier receptacle 112 is configured to be filled with 20-250 mm of water. According to some embodiments, the water level minimal height depends on the diameter of conduit 110 and maximal height depends on impeller 102 power to exert fluid upon operation of the semi-closed compartment gas management system 100 and removal of water from the barrier receptacle 112.

According to some embodiments, said ability of the semi-closed compartment gas management system 100 to operate by implementing various fluid barrier receptacles 112 having various diameters configured to be filled with various amounts of fluid, leads to high versatility of said system. As a consequence, the semi-closed compartment gas management system 100 may be configured to work with various impellers 102 having various outputs.

For example, a fluid barrier receptacle 112 having a diameter of 250 millimeter is configured to filled with a relatively large amount of fluid, and thus be configured to form a part of a system having relatively strong gas drawing output, or, alternatively, be configured to connect to a relatively large diameter conduits of a system, and vice versa.

According to some embodiments, said high versatility of the semi-closed compartment gas management system 100 may be beneficial in installing it in various hosting systems such as fume exhaust/hood a kitchen, restaurant, laboratory, etc.

According to some embodiments, float 113 may be equipped with block prevention means configured to be autonomously utilized upon a vertical movement of float 113 to prevent or remove any blockage such as scale deposits from the inlet aperture 116.

According to some embodiments, impeller 102 may be anchored to its position by a resilient connector 101. For example, impeller 102 may be anchored to a toilet tank 10 by a resilient connector 101 that may be made out of rubber, polymer, etc.

According to some embodiments, connector 101 may be configured to be acoustically isolated such that the operation of impeller 102/the semi-closed compartment gas management system 100 will not cause any disturbance to the user.

According to some embodiments, connector 101 may be configured to reduce vibrations caused by the operation of impeller 102 such that the operation of the semi-closed compartment gas management system 100 will not cause any disturbance to the user.

According to some embodiments, float 113 may be equipped with block prevention means configured to be autonomously utilized upon a vertical movement of float 113. According to some embodiments, float 113 may be configured to prevent or remove deposits (such as scale deposits, etc.) from the inlet aperture 116 by utilizing its block prevention means equipped with protrusion 117 which is designated to alternatively enter/out to/from fluid inlet aperture 116. For example, protrusion 117 may be a rod having ridges and grooves such as a screw, etc., wherein said ridges are adapted to remove scale deposits by scrubbing the inner diameter of inlet aperture 116 while float 113 moves vertically.

Reference is now made to FIG. 1C which schematically illustrates a semi-closed compartment gas management system 100 illustrated in FIGS. 1A and 1B and further configured to be installed within toilet tank 10. As shown, an impeller 102 is configured to be driven by a power source and create a gas flow by drawing air through a conduit inlet 104 being in communication with a toilet flushing device 200 and, in turn, from the semi-closed compartment created by a toilet bowl (not shown). According to some embodiments, conduit 110 comprises a conduit outlet 108 configured to discharge gas to a sewer pipeline in order to remove bad odors from the toilet bowl and prevent it from spreading within the toilet chamber.

As previously disclosed, and according to some embodiments, a fluid barrier receptacle 112 may be configured with a fluid inlet aperture 116 and wherein fluid barrier receptacle 112 is designated to be installed at any point along conduit 110. Fluid barrier receptacle 112 may further comprise a float section 113 configured to vertically move along conduit 110 in accordance with the water level in toilet tank 10. According to some embodiments, the float section 113 is restricted to vertically move along tracks 115. According to some embodiments, the fluid barrier receptacle 112 is configured to block gas originating from sewer pipeline from spreading to the semi-closed compartment.

According to some embodiments and as disclosed above, while the impeller 102 is not in operation, fluid barrier receptacle 112 provides a fluid barrier preventing gasses from passing and spreading to the semi closed compartment. According to some embodiments, receptacle 111 may be configured to store some amount of fluid designated to flow from the toilet tank 10 through the fluid inlet aperture 116 and fill fluid barrier receptacle 112, thus blocking gases from the sewer pipeline to flow into the toilet bowl.

According to some embodiments, while the impeller 102 is operating, water entering fluid barrier receptacle 112 through the inlet aperture 116 are discharged to the sewer pipeline through conduit outlet 108.

According to some embodiments, float 113 may be equipped with block prevention means (comprising protrusion 117 shown in FIG. 1B) configured to be autonomously utilized upon a vertical movement of float 113. For example, float 113 may be configured to prevent or remove scale deposits from the inlet aperture 116 by utilizing its block prevention means that such as protrusion 117 designated to alternatively enter/out to/from fluid inlet aperture 116.

The toilet tank 10 may comprise an opening 103 configured to provide access to its inner components for the purpose of service, maintenance, upgrades, etc. According to some embodiments, the semi-closed compartment gas management system 100 may be configured to be narrower from opening 103 such that it may be inserted and removed without a need of complicated disassembly of the toilet tank 10. This modular design provides a versatile system, ready to be installed in various commercially available toilet tanks.

Figure 2A:
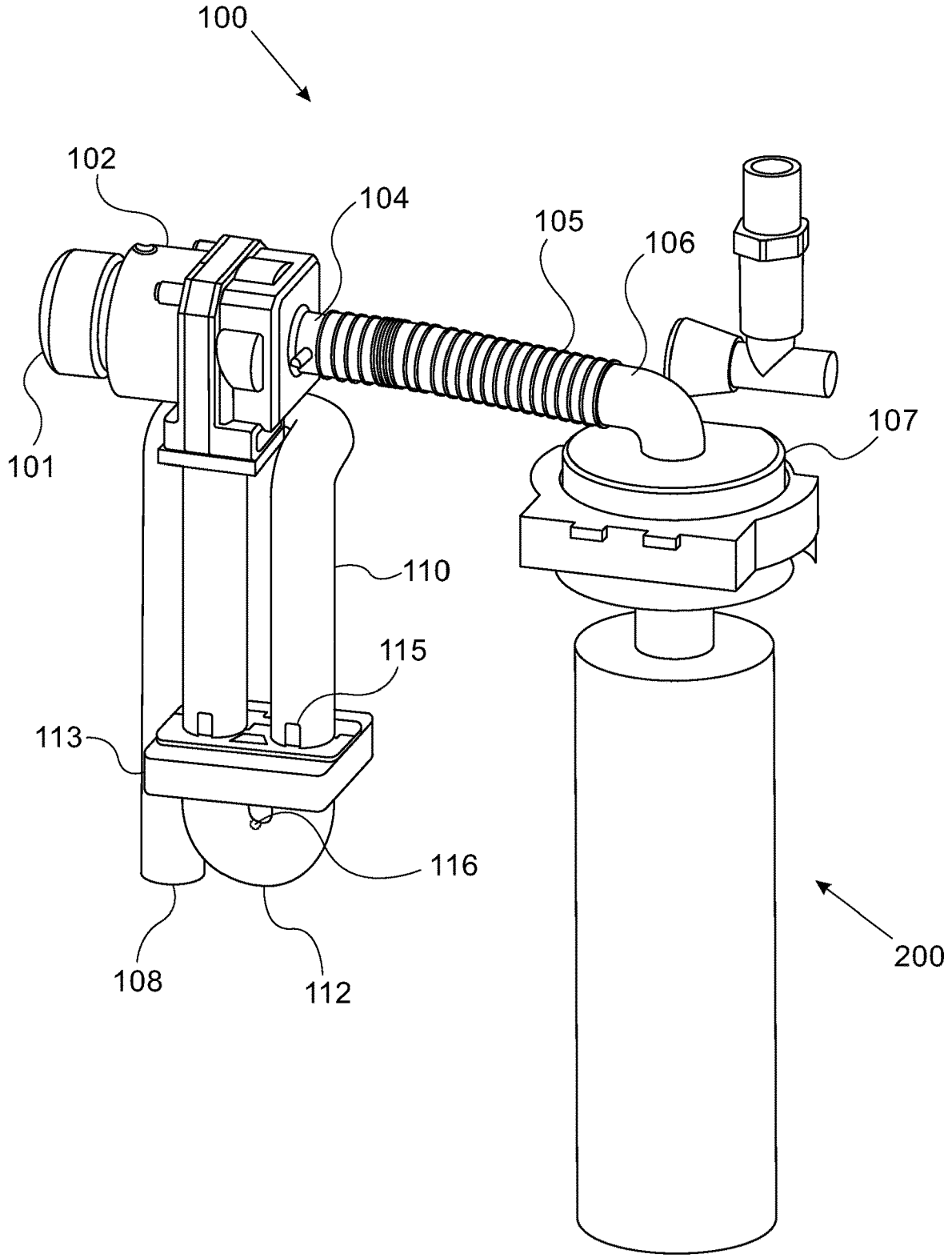
FIGS. 2A & 2B constitute schematic perspective views of a semi-closed compartment gas management system configured to be installed within a toilet tank, according to some embodiments of the invention.
Figure 2B:
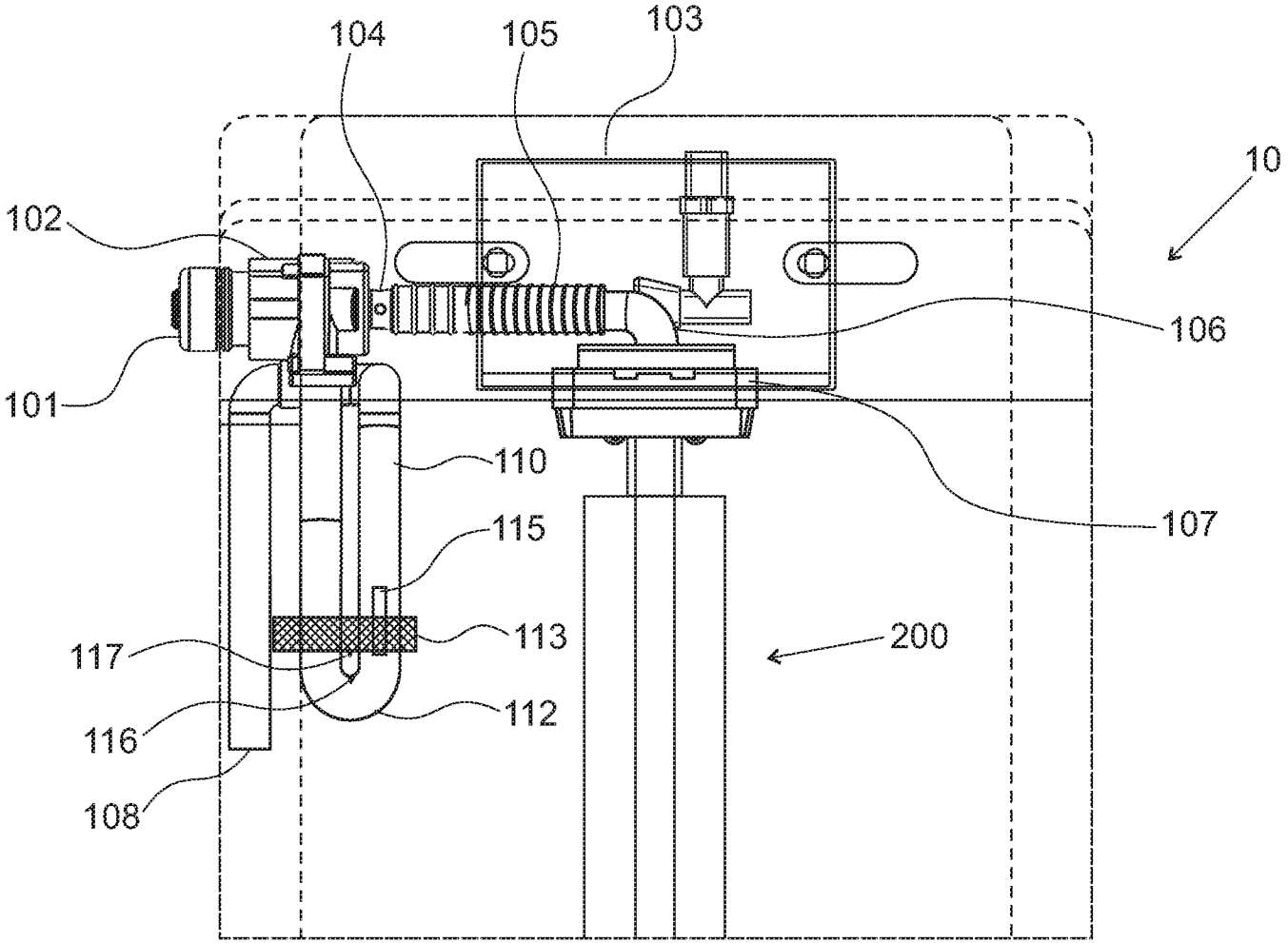

Reference is now made to FIGS. 2A & 2B which schematically illustrate another embodiment of a semi-closed compartment gas management system 100 configured to be installed within toilet tank 10. As shown, an impeller 102 is configured to be driven by a power source and create a gas flow by drawing air through a conduit inlet 104 being in communication with a toilet flushing device 200, and, in turn, from the semi-closed compartment created by a toilet bowl (not shown), to be discharged into a sewer pipeline through outlet conduit 108.

According to some embodiments, the fluid barrier receptacle 112 is configured to be located within a toilet tank 10, wherein the fluid barrier receptacle 112 may comprise an inlet aperture 116 configured to enable flow of water from the toilet tank 10 and into the fluid barrier receptacle 112.

According to some embodiments, while the impeller 102 is not in operation, the fluid barrier receptacle 112 is configured to block gas originating from the sewer pipeline from spreading to the semi-closed compartment, by providing a fluid barrier preventing gasses from passing and spreading to the toilet bowl. According to some embodiments, receptacle 112 may be a vertical U-shaped section of conduit 110 and may store a relatively small amount of water designated to flow from the toilet tank 10 through the fluid inlet aperture 116 and fill it, thus blocking gases from the sewer pipeline from spreading into the toilet bowl.

According to some embodiments, fluid barrier receptacle 112 is configured to be filled with 20-250 mm of water. According to some embodiments, the water level minimal height depends on diameter of conduit 110 and maximal height depends on impeller 102 power to exert fluid upon operation of the semi-closed compartment gas management system 100 and removal of water from the barrier receptacle 112.

According to some embodiments, while the impeller 102 is operating, water entering the U-shaped section of conduit 110 through the inlet aperture 116 are discharged to the sewer pipeline through conduit outlet 108.

According to some embodiments, fluid barrier receptacle 112 may be a vertical U-shaped turn of conduit 110, such that the vertical U-shaped section is configured to be alternatively filled with water and wherein fluid barrier receptacle 112 further comprising a float component 113 configured to be located above the U-shaped turn of conduit 110 and designated to be vertically adjustable in accordance with the water level within the toilet tank 10. According to some embodiments, the float component 113 is configured to operate as an autonomous block prevention means by comprising a protrusion 117 having a clearance gap fit with the inlet aperture 116.

According to some embodiments, float component 113 and protrusion 117 are configured to vertically move along tracks 115, hence alternately fit with the inlet aperture 117 in accordance to the water level in toilet tank 10. According to some embodiments, the alternating operation of the float component 113 and protrusion 117 is configured to prevent or remove scale deposits from inlet aperture 116.

According to some embodiments, when the impeller 102 is off and does not create a gas flow, the fluid barrier receptable 112, meaning, the vertical U-shaped turn of conduit 110, is full with fluid and configured to block odors originated in the sewer pipeline from spreading to the toilet bowl.

According to some embodiments, conduit inlet 104 may further be configured to connect to an adaptor 106 having a connector 107 configured to be connected to toilet flushing device 200, wherein the gas drawn by the impeller 102 is configured to be drawn through an over-flow pipe (not shown) forming a part of toilet flushing device 200, and, in turn, from the semi-closed compartment created by a toilet bowl (not shown) to be discharged into a sewer pipeline through outlet conduit 108. According to some embodiments, this allows the semi-closed compartment gas management system 100 to remove bad odors from the toilet bowl and prevent it from spreading within the toilet chamber.

According to some embodiments, said protrusion 117 is configured to alternately fit with the inlet aperture 116 in accordance with the water level in the toilet tank 10, thus, alternatively prevent or remove any blockage such as scale deposits from the inlet aperture 116.

According to some embodiments, impeller 102 may be anchored to its position by a resilient connector 101. For example, impeller 102 may be anchored to a toilet tank 10 of by a resilient connector 101 that may be made out of rubber, polymer, etc.

According to some embodiments, connector 101 may be configured to be acoustically isolated such that the operation of impeller 102/the semi-closed compartment gas management system 100 will not cause any disturbance to the user.

According to some embodiments, connector 101 may be configured to reduce vibrations caused by the operation of impeller 102 such that the operation of the semi-closed compartment gas management system 100 will not cause any disturbance to the user.

Figure 3A:
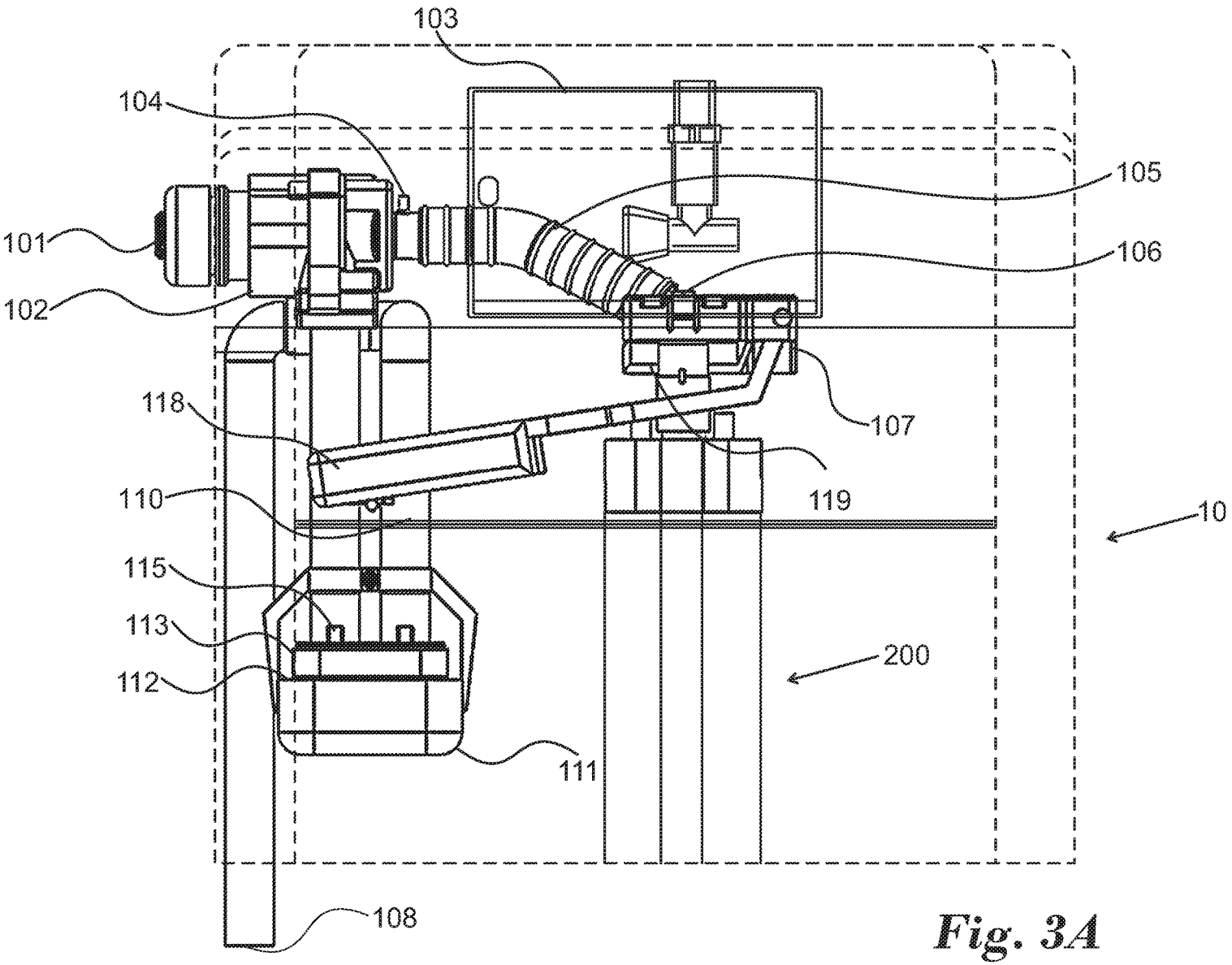
FIGS. 3A-3C constitute schematic perspective views of another embodiment of a semi-closed compartment gas management system configured to be installed within a toilet tank, according to some embodiments of the invention.
Figure 3B:
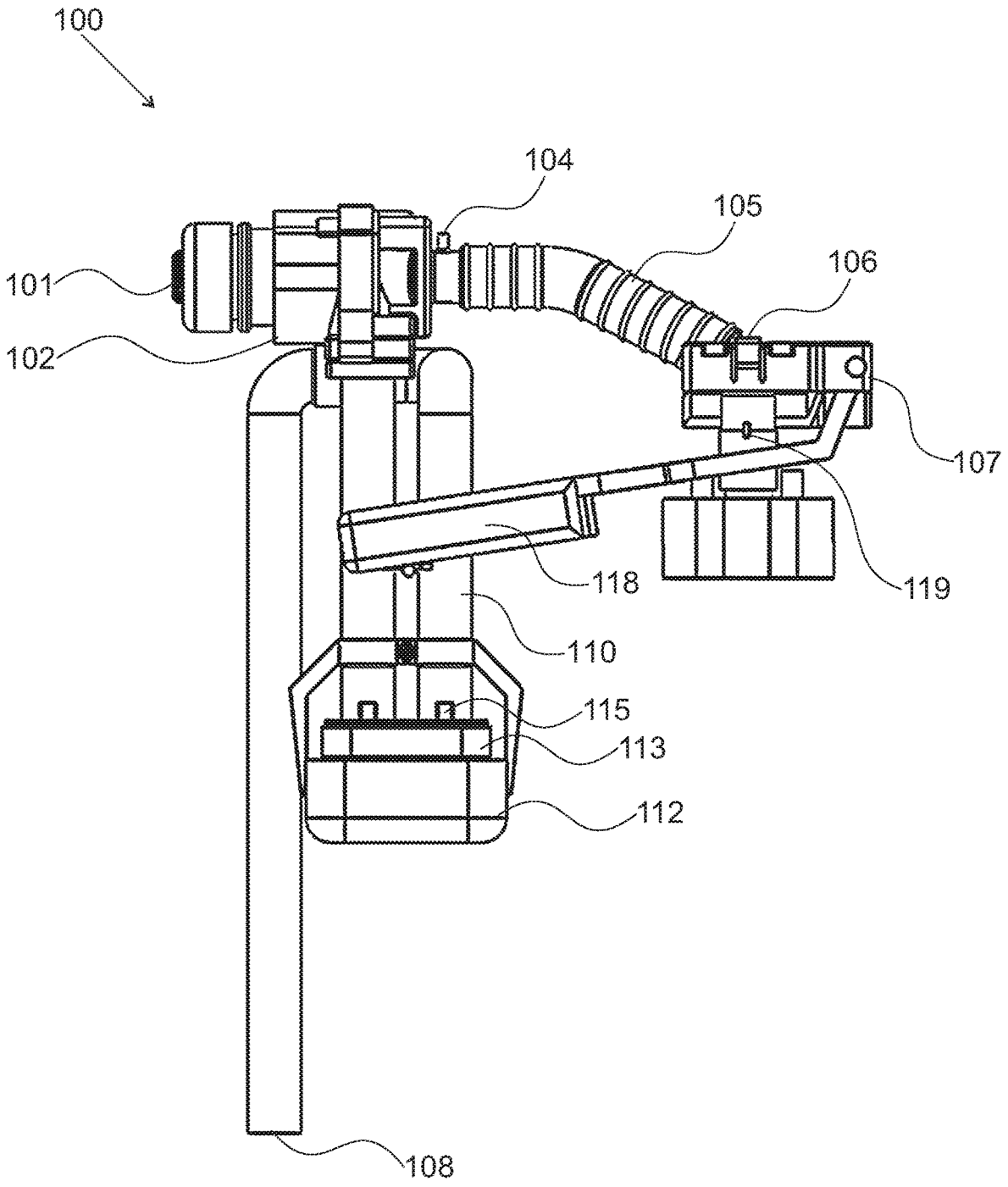
Figure 3C:
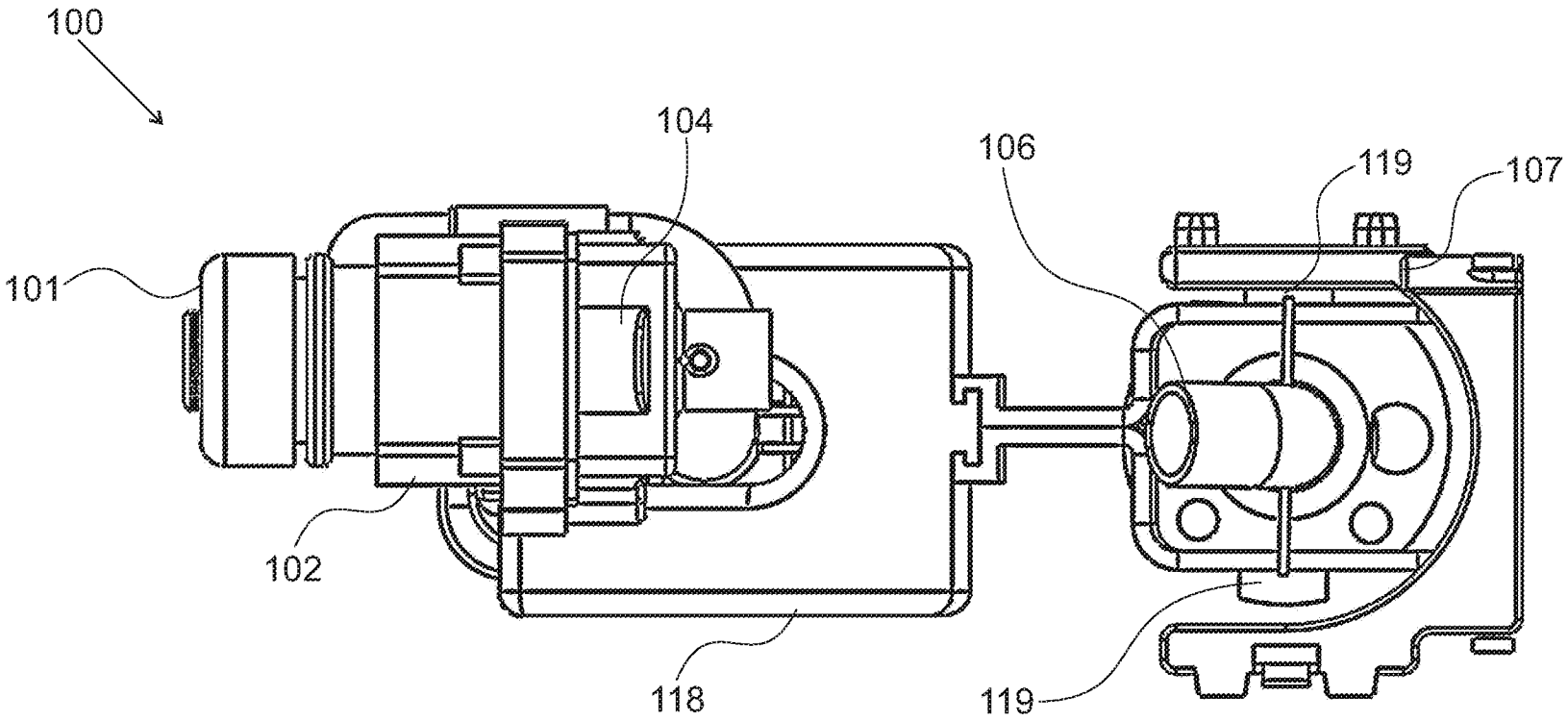

Reference is now made to FIGS. 3A-3C which schematically illustrate multiple views of another embodiment of a semi-closed compartment gas management system 100 configured to be installed within toilet tank 10. As shown, an impeller 102 is configured to be driven by a power source and create a gas flow by drawing air through a conduit inlet 104 being in communication with a toilet flushing device 200, and, in turn, from the semi-closed compartment created by a toilet bowl (not shown).

According to some embodiments, receptacle 111 may be configured to contain some amount of fluid by preserving a constant amount of water even when the water level within the toilet tanks 10 is low. This configuration provides a barrier against unpleasant odors by allowing fluid to enter the fluid inlet aperture 116 even when the toilet tank 10 is not full or empty.

According to some embodiments, receptacle 111 may be filled with a pre-contained fluid reservoir. This configuration provides a barrier against unpleasant odors by allowing fluid to enter the fluid inlet aperture 116 even when the toilet tank 10 empty for a long period of time is empty for long period of time, or, alternatively, when the semi-closed compartment gas management system 100 is configured to be installed in a hosting system that lacks a water tank.

According to some embodiments, conduit inlet 104 may further be configured to connect to an adaptor 106 having a connector 107 configured to be connected to toilet flushing device 200, wherein the gas drawn by the impeller 102 is configured to be drawn through an over-flow pipe (not shown) forming a part of toilet flushing device 200, and, in turn, from the semi-closed compartment created by a toilet bowl (not shown) to be discharged into a sewer pipeline through outlet conduit 108. According to some embodiments, this allows the semi-closed compartment gas management system 100 to remove bad odors from the toilet bowl and prevent it from spreading within the toilet chamber.

As previously disclosed, and according to some embodiments, a fluid barrier receptacle 112 may be configured with a fluid inlet aperture 116 (shown in FIGS. 1 & 2) and designated to be installed at any point along conduit 110. fluid barrier receptacle 112 may further comprise a float section 113 configured to vertically move along conduit 110. According to some embodiments, float section 113 is restricted to vertically move along tracks 115. According to some embodiments, the fluid barrier receptacle 112 is configured to block gas originating from sewer pipeline from spreading to the semi-closed compartment.

According to some embodiments, while the impeller 102 is not operating, fluid barrier receptacle 112 provides a fluid barrier preventing gasses from passing and spreading by storing a relatively small amount of water designated to flow from the toilet tank 10 through the fluid inlet aperture and fill it, thus blocking gases from the sewer pipeline to flow into the toilet bowl.

According to some embodiments, while the impeller 102 is operating, water entering fluid barrier receptacle 112 through the inlet aperture 116 are discharged to the sewer pipeline through conduit outlet 108.

According to some embodiments, float 113 may be further equipped with block prevention means configured to be utilized upon a vertical movement of float 113 to prevent or remove any blockage such as scale deposits from the inlet aperture.

According to some embodiments, a float 118, may be configured to be connected to flushing device 200 and provide levering mechanism controlling the water level within toilet tank 10. According to some embodiments, float 118 may be configured to be installed upon a flushing device and provide a malfunction protection in case of unregulated water level within the toilet tank 10.

According to some embodiments, a float 118 may be configured to be mounted upon a generic float mechanism associated with a generic flushing device in order to enable installation of the semi-closed compartment gas management system 100 within a commercially available toilet tank.

According to some embodiments, float 118 may be configured to manipulate the flushing mechanism in case of water within the toilet tank 10 rising above a certain predesignated level (for example, 6 liters, 9 liters, etc.) that may cause a spillage. In that case, the lever connected to float 118 may be configured to lift a valve (not shown) which in turn may allow rising water to be evacuated to the discharge means.

According to some embodiments, the lever connected to float 118 may be configured to lift said valve by lifting designated protrusion/s 119, thus allow rising water to be evacuated to the discharge means.

According to some embodiments, float 118 may have a compact shape/size due to the presence of the semi-closed compartment gas management system 100 within the limited space of the toilet tank 10. For example, float 118 may form a U-shape having two lobes configured to spread around the gas management system 100 such that the lobes are located outwardly and laterally to conduit 110. According to some embodiments, float 118 may be in any shape or form that exhibit a compact design designated to save room within toilet tank 10.

According to some embodiments, impeller 102 may be anchored to its position by a resilient connector 101. For example, impeller 102 may be anchored to a toilet tank of by a resilient connector 101 that may be made out of rubber, polymer, etc.

According to some embodiments, connector 101 may be configured to be acoustically isolated such that the operation of impeller 102/the semi-closed compartment gas management system 100 will not cause any disturbance to the user.

According to some embodiments, connector 101 may be configured to reduce vibrations caused by the operation of impeller 102 such that the operation of the semi-closed compartment gas management system 100 will not cause any disturbance to the user.

Figure 4:
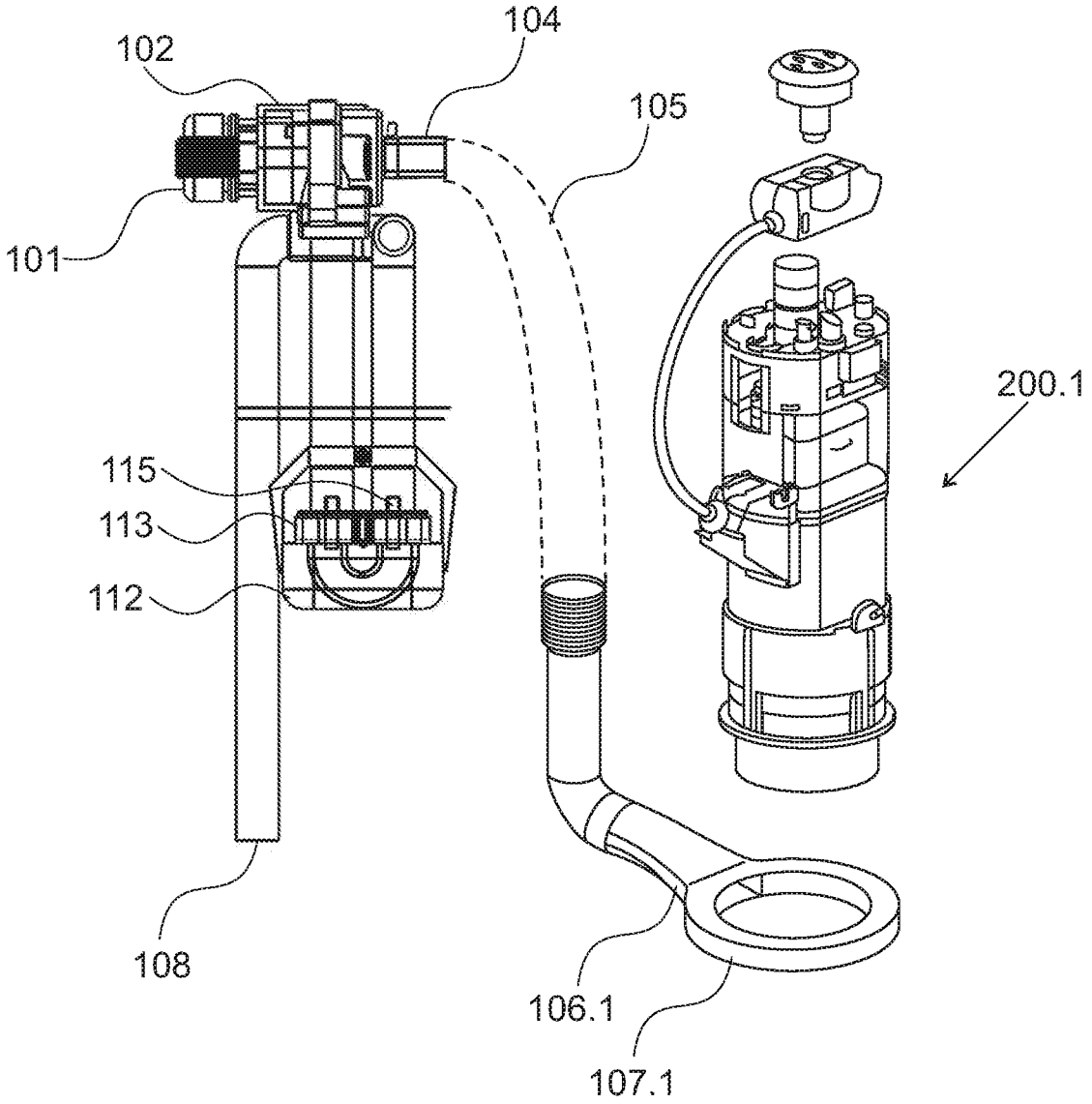
FIG. 4 constitutes a schematic perspective view of another embodiment of a semi-closed compartment gas management system configured to be installed within a toilet tank, according to some embodiments of the invention.

Reference is now made to FIG. 4 which schematically illustrates yet another embodiment of a semi-closed compartment gas management system 100 configured to be installed within toilet tank 10. As shown, a flushing device 200.1 represents a known design that does not enable the semi-closed compartment gas management system 100 to connect to its upper side. Instead, connector 107.1 and adaptor 106.1 are configured to be connected to the lower side of flushing device 200.1.

According to some embodiments, an impeller 102 is configured to be driven by a power source and create a gas flow by drawing air through a conduit inlet 104 being in communication with the lower side of toilet flushing device 200.1, and, in turn, from the semi-closed compartment created by a toilet bowl (not shown) to be discharged into a sewer pipeline through outlet conduit 108. According to some embodiments, this allows the semi-closed compartment gas management system 100 to remove bad odors from the toilet bowl and prevent it from spreading within a toilet chamber.

According to some embodiments, receptacle 111 may be configured to contain some amount of fluid by preserving a constant amount of water even when the water level within the toilet tanks 10 is low. This configuration provides a barrier against unpleasant odors by allowing fluid to enter the fluid inlet aperture 116 even when the toilet tank 10 is not full or empty.

According to some embodiments, receptacle 111 may be filled with a pre-contained fluid reservoir. This configuration provides a barrier against unpleasant odors by allowing fluid to enter the fluid inlet aperture 116 even when the toilet tank 10 empty a long period of time.

According to some embodiments, impeller 102 may be anchored to its position by a resilient connector 101. For example, impeller 102 may be anchored to a toilet tank of by a resilient connector 101 that may be made out of rubber, polymer, etc.

According to some embodiments, connector 101 may be configured to be acoustically isolated such that the operation of impeller 102/the semi-closed compartment gas management system 100 will not cause any disturbance to the user.

According to some embodiments, connector 101 may be configured to reduce vibrations caused by the operation of impeller 102 such that the operation of the semi-closed compartment gas management system 100 will not cause any disturbance to the user.

Figure 5:
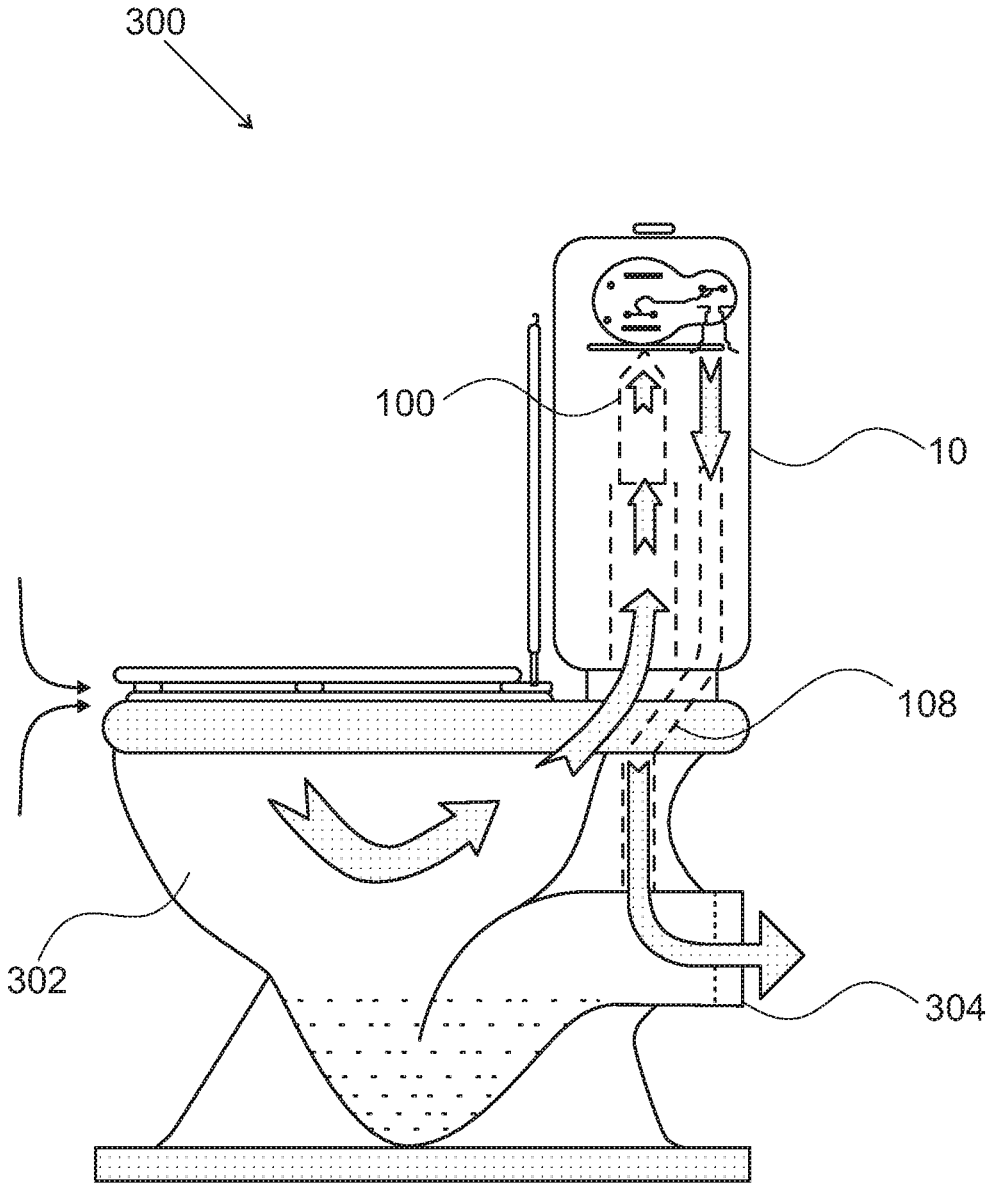
FIG. 5 constitutes a schematic perspective view of a semi-closed compartment gas management system installed in a commercially available toilet assembly, according to some embodiments of the invention.

Reference is now made to FIG. 5 which schematically illustrates a semi-closed compartment gas management system 100 configured to be installed within a commercially available toilet assembly 300. As shown, semi-closed compartment gas management system 100 is configured to be installed within toilet tank 10, and, upon operation, draw gas from the toilet bawl 302 and into sewage pipeline 304.

According to some embodiments, upon operation of the semi-closed compartment gas management system 100, the direction of the arrows indicates the direction of gas flowing from bawl 302 and into sewage pipeline 304 such that a constant sub-pressure is created within toilet bowl 302 and prevents gases/unpleasant odors from spreading.

Figure 6A:
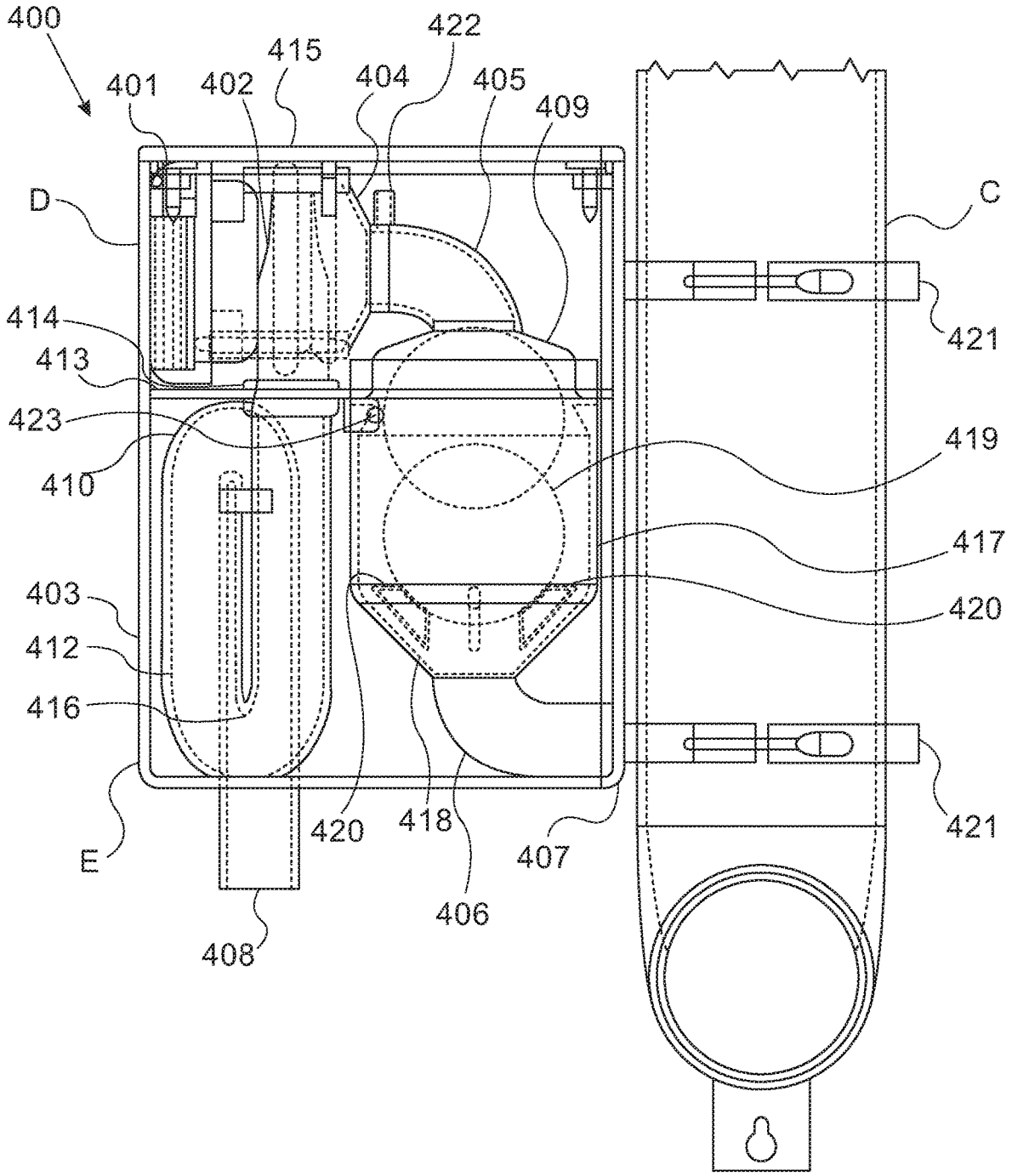
FIGS. 6A & 6B constitute schematic perspective views of a semi-closed compartment gas management system components, according to some embodiments of the invention.
Figure 6B:
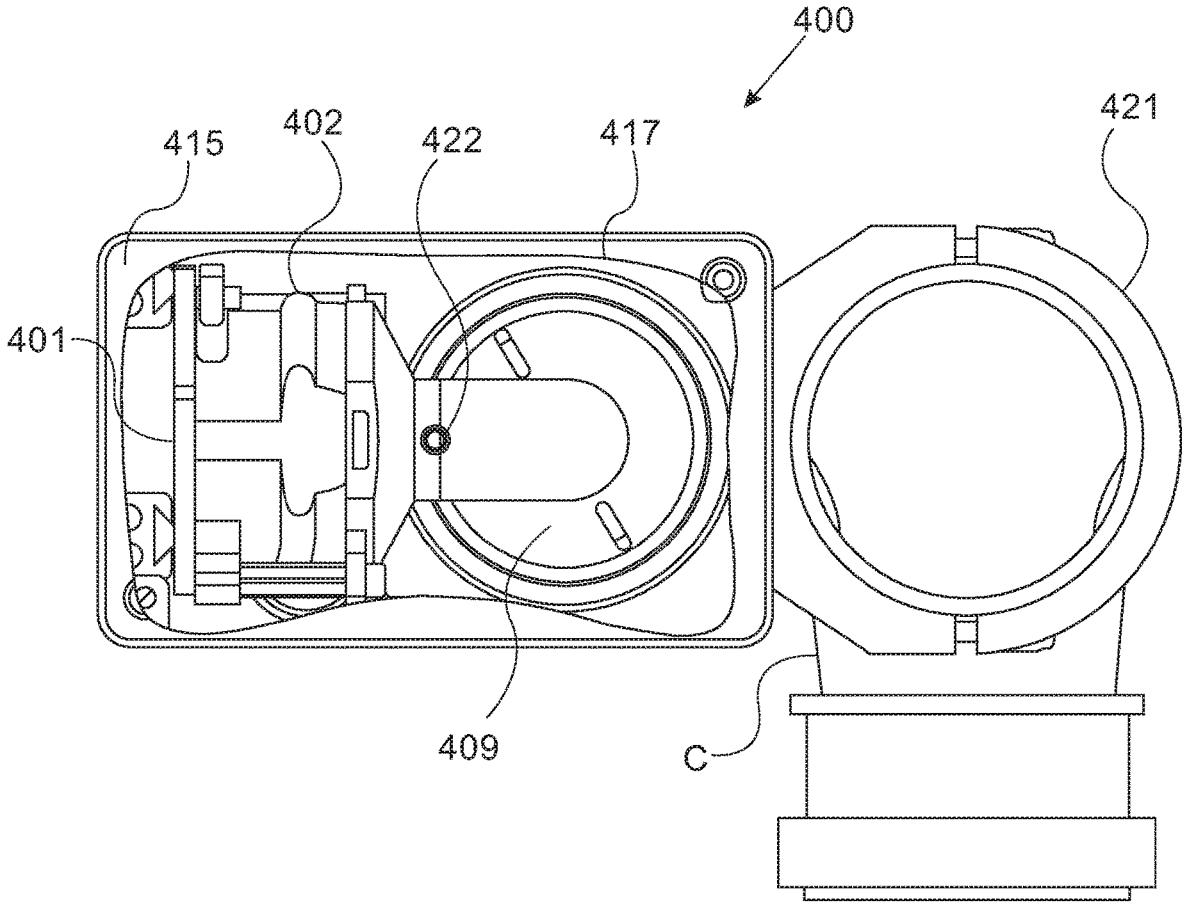

Reference is now made to FIGS. 6A & 6B, which schematically illustrates a semi-closed compartment gas management system 400, according to some embodiments. As shown, the semi-closed compartment gas management system 400 may be configured to connect to a pipe C that provides fluids to a semi-closed compartment. For example, a semi-closed compartment gas management system 400 may be configured to be attached to a water pipe providing water flow to a toilet cistern.

According to some embodiments, an impeller 402 is configured to be driven by a power source and create a gas flow. For example, impeller 402 may be a blower configured to create an air stream. According to some embodiments, impeller 402 may be powered by a wall socket electrical connection/by a power reserve such a battery/by a mechanical mechanism converting water stream to electricity/by inductive charging, or any other known powering technology.

According to some embodiments, impeller 402 may be configured to create a gas flow passing through a conduit comprising different sections. For example, impeller 402 may be configured to create a gas flow passing through a conduit inlet 404, along conduit section 410 and discharged through conduit outlet 408 to a discharge means such as a sewer pipeline.

According to some embodiments, conduit inlet 404 may be configured to be in an indirect communication with the semi-closed compartment. (not shown) through pipe C.

According to some embodiments, a semi-closed compartment may be any receptacle/chamber having an inner volume that is not completely sealed to its outer environment. For example, a semi-closed compartment may be a restroom, a kitchen, a restaurant, a laboratory, an exhaust hood, a toilet bawl, etc.

According to some embodiments, a fluid barrier receptacle 412 may be configured with a fluid inlet aperture 416 and designated to form a part of/be installed at any point along conduit 410. According to some embodiments, fluid barrier receptacle 412 may have a siphon configuration, for example, fluid barrier receptacle 412 may be a siphon shaped as an inverted "U" shaped conduit.

According to some embodiments, an adaptor 406 having a connector 407 may be configured to be directly connected to the semi-closed compartment through pipe C. According to some embodiments, trap valve 417 is adapted to connect to adaptor 406 from one side, and to the conduit inlet 404 from another side. According to some embodiments, conduit inlet 404 may be connected through conduit section 405 to cup 409 designated to provide a cover to trap valve 417.

According to some embodiments, when water is flowing down pipe C, the water pressure displaces some amount of water into connector 407 and then to adaptor 406, filling the inner volume of trap valve 417. According to some embodiments, trap valve 417 may be a receptacle having wider dimensions in comparison with the perimeters of conduit inlet 404/adaptor 406 configured to connect to its ends.

According to some embodiments, trap valve 417 may further comprise a support 418 configured to provide a rest to float 419 which, upon water rising within trap valve 417, is designated to float and block the entrance to conduit 405. According to some embodiments, float 419 may be a floating ball adapted in its diameter to provide a seal against fluids while floating upon rising water level within the valve device and encounter a narrower portion of trap valve 417

According to some embodiments, support 418 may be configured with air passageway/s 420 designated to allow the air filling pipe C (when water is not running through it) to flow through adaptor 406, into the inner volume of trap valve 417, through conduit 405, through fluid barrier receptacle 412 and out through conduit outlet 408.

According to some embodiments, casing 403 is configured to contain some amount of fluid by preserving a constant amount of fluid within the inner volume of the semi-closed compartment gas management system 400. This configuration provides a barrier against unpleasant odors by allowing fluid to enter the fluid inlet aperture 416 and fill the fluid barrier receptacle 412 when the impeller 402 is not operating.

According to some embodiments, trap valve 417 further comprising fluid passageway/s 423 configured to allow a certain amount of water to flow and fill casing 403 and provide a reservoir that may enter the fluid inlet aperture 416 and fill the fluid barrier receptacle 412 when the impeller 402 is not operating.

According to some embodiments, casing 403 may be filled with a pre-contained fluid reservoir. This configuration provides a barrier against unpleasant odors by allowing fluid to enter the fluid inlet aperture 416 even when pipe C is, from any reason, not providing fluid to casing 403 or alternatively, when the semi-closed compartment gas management system 400 is configured to be installed in a hosting system that lacks a water supply.

According to some embodiments, fluid inlet aperture 416 may have a relatively large diameter, hence, reducing the probability of blockage. For example, fluid inlet aperture 416 may have a diameter of at least 5 mm which is wide enough to prevent scale deposits from building up and blocking fluid inlet aperture 416. This relatively large diameter may also prevent other contaminants from blocking fluid inlet aperture 416.

According to some embodiments, the inner volume of the semi-closed compartment gas management system 400 is configured to be separated by partition 413, thus creating inner volumes D and E surrounded by casing 403. According to some embodiments, partition 413 may further comprise opening 414 configured to be alternatively sealed with a lid (not shown). According to some embodiments, opening 414 may allow the insertion of a designated prob/rod configured to penetrate into aperture 416 in order to remove any blockage such as scale deposits, etc. According to some embodiments, the rod may be equipped with ridges and grooves (for example, screw, etc.), wherein said ridges are adapted to remove scale deposits by scrubbing the inner diameter of aperture 416.

According to some embodiments, opening 414 may be accessible by removing impeller 402 that may be accessible through a removable upper lid 415 forming a part of casing 403.

According to some embodiments, the fluid barrier receptacle 412 is configured to block gas originating from the discharge means from spreading to the semi-closed compartment while the impeller 402 is not operating, by providing a receptacle full of fluid, thus preventing gasses from passing and spreading.

According to some embodiments, fluid barrier receptacle 412 is configured to be filled with 20-250 mm of water. According to some embodiments, the water level minimal height depends on the diameter of conduit 410 and maximal height depends on the impeller 402 power to exert fluid upon operation of the semi-closed compartment gas management system 400 that causes the removal of water from the barrier receptacle 412.

According to some embodiments, said ability of the semi-closed compartment gas management system 400 to operate by implementing various fluid barrier receptacles 412 having various diameters configured to be filled with various amounts of fluid, leads to high versatility of said system. As a consequence, the semi-closed compartment gas management system 400 may be configured to work with various impellers 402 having various outputs.

For example, a fluid barrier receptacle 412 having a diameter of 250 millimeter is configured to filled with a relatively large amount of fluid, and thus be configured to form a part of a system having relatively strong gas drawing output, or, alternatively, be configured to connect to a relatively large diameter conduits of a system, and vice versa.

According to some embodiments, said high versatility of the semi-closed compartment gas management system 400 may be beneficial in installing it in various hosting systems such as fume exhaust/hood a kitchen, restaurant, laboratory, etc.

According to some embodiments, impeller 402 may be anchored to its position by a resilient connector 401. For example, impeller 402 may be anchored to the wall of casing 403 by a resilient connector 401 that may be made out of rubber, polymer, etc.

According to some embodiments, connector 401 may be configured to be acoustically isolated such that the operation of impeller 402/the semi-closed compartment gas management system 100 will not cause any disturbance to the user.

According to some embodiments, connector 401 may be configured to reduce vibrations caused by the operation of impeller 402 such that the operation of the semi-closed compartment gas management system 400 will not cause any disturbance to the user.

According to some embodiments, the semi-closed compartment gas management system 400 is configured to be attached to pipe C using fasteners 421. For example, the semi-closed compartment gas management system 400 may be configured to be attached to pipe C using metal/polymer cable ties, magnetic attachment means, adhesive means, Scotch (Velcro) fasteners or any other known attachment technique. According to some embodiments, the semi-closed compartment gas management system 400 may be configured to be attached to pipe C on any available face. For example, the semi-closed compartment gas management system 400 may be configured to be attached to pipe C on either side, front of rear sides, or on any upward, downward or inclined face of pipe C.

According to some embodiments, a designated aperture may be drilled to form a passageway between pipe C and connector 407. According to some embodiments, a tight fit between pipe C's aperture and connector 407 may be achieved by any sort of insulating technique (such as washers, silicon, foam, wool, etc.)

According to some embodiments, the semi-closed compartment gas management system 400 may further comprise means for sampling the drawn gas from pipe C and at least one sensor configured to analyze said sample. According to some embodiments, the sensor may be configured to collect data regarding the sampled drawn gas. For example, the semi-closed compartment gas management system 400 installed on pipe C providing water flow to a toilet bowl, may be configured with diagnosis passageway/s 422 allowing gas to flow from the semi close compartment and reach a sensor (not shown) configured to analyze the bio-medical condition of a user by sampling gas generated by said user digestion system or diagnose the characteristics of various gas odors during and after a user uses the toilet bowl. By way of another example, the semi-closed compartment gas management system 400 coupled with a laboratory fume hood may be configured to perform real time analysis of laboratory work products and identify hazardous material situations.

According to some embodiments, the semi-closed compartment gas management system 400 may comprise a controller configured to diagnose collected data by analyzing the sensor output data. According to some embodiments, the gathered data may be transmitted to a designated device or data center for further analysis or display. According to some embodiments, said transmittal of the gathered data may be conducted on an immediate real-time basis in order to provide a fast detection system.

Although the present invention has been described with reference to specific embodiments, this description is not meant to be construed in a limited sense. Various modifications of the disclosed embodiments, as well as alternative embodiments of the invention will become apparent to persons skilled in the art upon reference to the description of the invention. It is, therefore, contemplated that the appended claims will cover such modifications that fall within the scope of the invention.

The invention claimed is:

1. A semi-closed compartment gas management system, comprising:

(i) a power source, (ii) an impeller configured to be driven by the power source and create a gas flow, (iii) a conduit having a gas inlet in communication with a semi-closed compartment and an outlet in contact with a discharge means, (iv) a fluid barrier receptacle comprises a fluid inlet supine aperture and configured to be connected to the conduit between its gas inlet and outlet and further comprises a float component, wherein the gas flow created by the impeller is designated to flow from the semi-closed compartment and through the conduit and wherein the fluid barrier receptacle is configured to block gas originating from the discharge means from spreading to the semi-closed compartment while the impeller is not operating and, wherein the float component is vertically adjustable and configured to operate autonomously in order to prevent block by utilizing a protrusion characterized as a rod having ridges and grooves and having a clearance gap fit with the fluid inlet aperture, and wherein the alternating operation of the float component that comprises the protrusion entering and exiting the inlet aperture is configured to prevent or remove scale deposits from the inlet aperture.

2. The system of claim 1 wherein:

the gas flow created by the impeller is induced by drawing air through a conduit inlet being in communication with a toilet bowl functioning as the semi-closed compartment, the fluid barrier receptacle is configured to be located within a toilet tank and comprising the inlet aperture configured to enable flow of water from the water tank into the fluid barrier receptacle, the fluid barrier receptacle further comprising a float component external to the fluid barrier receptacle, wherein the gas drawn by the impeller is discharged into a sewer pipeline functioning as the discharge means, wherein the fluid barrier receptacle is configured to block odors originated in the sewer pipeline from spreading to the toilet bowl, and wherein said protrusion is configured to have an alternating operation of entering and exiting the inlet aperture in accordance with the water level in the toilet tank.

3. The system of claim 2, wherein the conduit is configured to connect to an over-flow pipe forming a part of a toilet bowl flushing device.

4. The system of claim 2, wherein the semi-closed compartment gas management system is configured by modular commercially available components.

5. The system of claim 2, wherein the semi-closed compartment gas management system is configured to be compactly fitted and installed within commercially available toilet bowl flushing systems.

6. The system of claim 2, wherein the float component is configured as a fluid reservoir of toilet tank, by containing water in said float component prior or during flushing and wherein said water are designated to enter the fluid barrier receptacle through the inlet aperture upon termination of gas removal action.

7. The system of claim 1, wherein the impeller is configured to be acoustically isolated.

8. The system of claim 1, wherein the fluid barrier receptacle is configured to be filled with fluid entering through the inlet aperture.

9. The system of claim 1, wherein the fluid barrier receptacle is configured to be filled with fluid sourced from a pre-contained reservoir entering through the inlet aperture.

10. The system of claim 1, further comprising means for sampling the drawn gas and at least one sensor, wherein the sample is designated to be exposed to the sensor(s), wherein at least one sensor is configured to collect data regarding the sampled drawn gas, wherein at least one sensor is associated with a controller configured to diagnose collected data by analyzing at least one sensor output, wherein the system is configured to transmit the gathered data to a designated device or data centre for further analysis or display.

11. The system of claim 1, wherein the semi-closed compartment is a fume hood and wherein the system is configured to draw air from inner cavity of the exhaust hood and dispose it into a discharge pipe.

12. The system of claim 1, wherein the power source is a rechargeable power reservoir.

13. The system of claim 12, wherein the rechargeable power reservoir is configured to be charged by a water flow created when a toilet tank is filled.

14. The system of claim 1, wherein the fluid barrier receptacle is configured to be filled with 20-250 mm of water.

15. The system of claim 1 wherein the fluid barrier receptacle is a U-shaped conduit.

16. The system of claim 1, wherein the fluid barrier receptacle has a compact siphon configuration.

17. The system of claim 1, wherein the inlet aperture is configured to allow entrance of fluid filling the water barrier receptacle and wherein upon operation the impeller is configured to draw water from the water barrier receptacle and dispose of it into the discharge means.

18. The system of claim 1, wherein the semi-closed compartment gas management system is operable by a remote control.

19. The system of claim 18, wherein the remote control is a cellular, Bluetooth or Wi-Fi application.

20. A method for using a semi-closed compartment gas management system, comprising the steps of:

(i) applying an impeller to create a gas flow through a conduit having a gas inlet in communication with a semi-closed compartment and an outlet in contact with a discharge means, characterized in that said flow also passes through a fluid barrier receptacle comprising a fluid inlet supine aperture and configured to be connected to the conduit between its gas inlet and outlet, (ii) utilizing said gas flowing from the semi-closed compartment through the conduit and the fluid barrier receptacle in order to discharge gas from the semi-closed compartment, and (iii) utilizing the fluid barrier receptacle to block gas originating in the discharge means from spreading to the semi-closed compartment when the impeller is not operating, (iv) utilizing a float component vertically adjustable and configured to operate autonomously in order to prevent block by using a protrusion characterized by a rod having ridges and grooves and having a clearance gap fit with the fluid inlet aperture, and wherein the alternating operation of the float component that comprises the protrusion entering and exiting the inlet aperture is configured to prevent or remove scale deposits from the inlet aperture.

* * * * *